United States Patent [19]

Kline

[11] Patent Number: 4,583,703

[45] Date of Patent: Apr. 22, 1986

[54] ONE FIN ORIENTATION AND STABILIZATION DEVICE

[75] Inventor: Roy W. Kline, Newton, N.J.

[73] Assignee: The United States of America as represented by the Secretary of the Army, Washington, D.C.

[21] Appl. No.: 653,570

[22] Filed: Sep. 24, 1984

Related U.S. Application Data

[63] Continuation-in-part of Ser. No. 358,946, Mar. 17, 1982, abandoned.

[51] Int. Cl.[4] ..... F42B 13/32; F42B 15/053; F42B 25/20

[52] U.S. Cl. ..... 244/3.24; 102/388; 244/3.27

[58] Field of Search ..... 102/384–388, 102/393, 394; 244/3.24, 3.27, 3.28, 3.29; 446/34, 36, 45

[56] References Cited

U.S. PATENT DOCUMENTS

| | | | |
|---|---|---|---|
| D. 137,155 | 1/1944 | Lewis | 446/34 |
| 2,667,352 | 1/1954 | Sepersky | 446/45 |
| 2,921,404 | 1/1960 | Lescher | 446/34 |
| 3,273,834 | 9/1966 | Bower | 102/388 |
| 3,353,295 | 11/1967 | Downey | 446/45 |
| 3,604,352 | 9/1971 | Bench | 102/386 |
| 3,691,674 | 9/1972 | Thompson | 446/34 |
| 4,050,381 | 9/1977 | Heinemann | 102/387 |
| 4,356,770 | 11/1982 | Atanasoff et al. | 102/384 |

FOREIGN PATENT DOCUMENTS

| | | | |
|---|---|---|---|
| 1161026 | 8/1958 | France | 446/34 |
| 641589 | 8/1950 | United Kingdom | 446/34 |

*Primary Examiner*—Charles T. Jordan

*Attorney, Agent, or Firm*—Anthony T. Lane.; Robert P. Gibson; Michael C. Sachs

[57] ABSTRACT

An orientation and stabilization device for a submunition is disclosed. A low profile cylindrical submunition body has a single fin attached thereto at an asymmetrically located position with respect to the central axis of the cylindrical body. The fin is tip weighted in such a way that, when the submunition falls through the air, a constant spin and vertical velocity is established, with the major axis of the cylindrical body disposed at an angle to the descent path.

7 Claims, 7 Drawing Figures

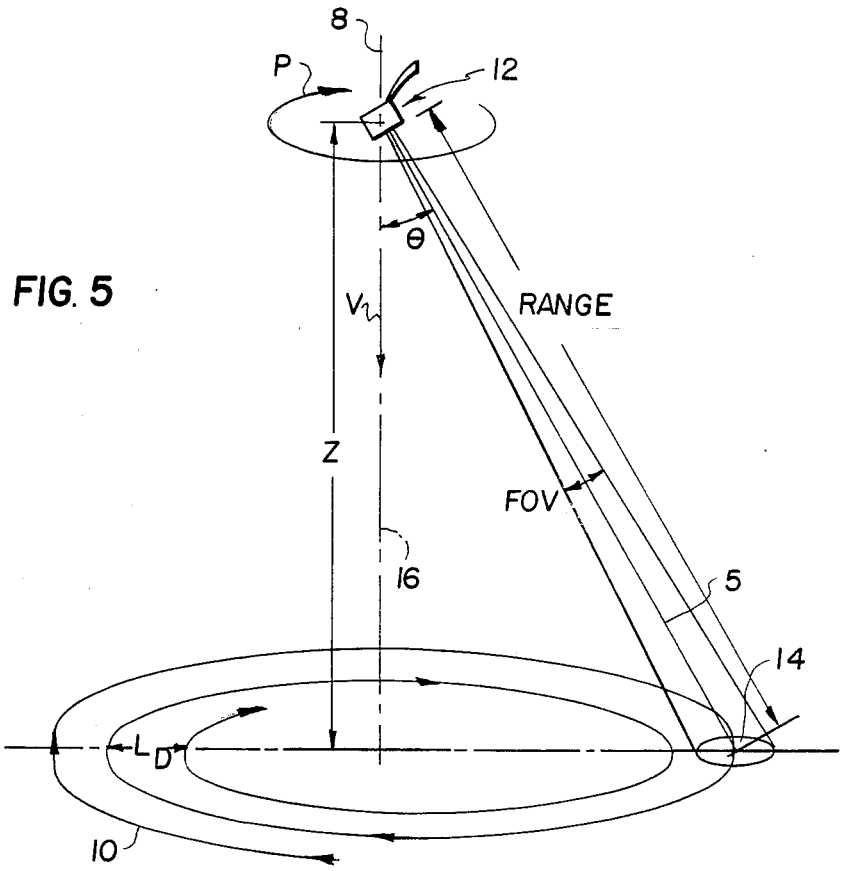
FIG. 5
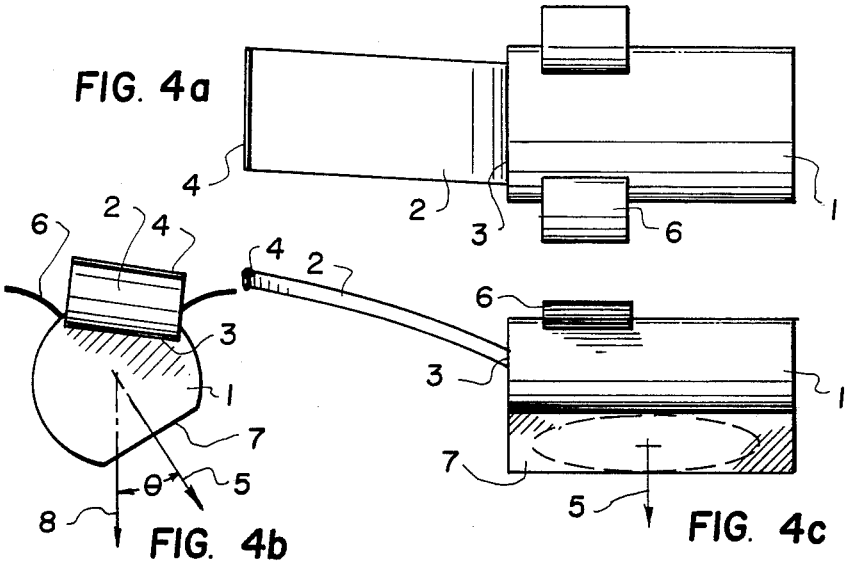
FIG. 4a
FIG. 4b
FIG. 4c

ONE FIN ORIENTATION AND STABILIZATION DEVICE

GOVERNMENTAL INTEREST

The invention described herein may be manufactured, used and licensed by or for the Government for Governmental purposes without the payment to the inventor of any royalties thereon.

This application is a continuation-in-part of application Ser. No. 358,946, filed Mar. 17, 1982, now abandoned, which is incorporated by reference herein.

FIELD AND BACKGROUND OF THE INVENTION

The present invention relates in general to the development of submunitions and the stabilization of short, blunt or low fineness ratio bodies, and in particular to a new and useful orientation and stabilization device for a search and destroy armor (SADARM) type submunition which includes a target sensor and a self forging fragment warhead.

SADARM submunitions are known which are intended for release from aircraft or ejected from artillery projectiles. Such devices then search for and destroy vehicular or other targets. The orientation and stabilization devices of the prior art in the SADARM system include a Vortex Ring Parachute. A friction clutch and a first stage decelerator are incorporated to attenuate carrier projectile spin and aerodynamic loading. Additionally, a Ram Air Inflated Device first stage must be configured to disperse the submunitions.

The Vortex Ring Parachute which rotates the submunition at a spin rate which is proportional to the descent velocity, imparts an inherent yawing motion to the assembly and is sensitive to wind. This causes distortion in the scan pattern. Staging is also required so that, in a first stage, deceleration/despin is accomplished to prevent damage to the main stage parachute.

Another technique for generating a scan pattern for a submunition was developed by the AVCO Corp. under the name of SKEET. In this device a rigid arm with tip weight is deployed from the submunition so that the sensing axis of the submunition is tilted with respect to its descent path. With the arm extended a principal axis of inertia of the submunition is aligned at an angle with respect to the cylindrical submunition axis. Thus a steady rotation about a new principal axis of inertia results. Since the arm and tilt weight are relatively small in area, the aerodynamic force acting on them are small. The disadvantage in launching a SKEET type device from a low height of a burst carrier vehicle that has a substantially horizontal velocity component (such as an artillery projectile) is that the spin axis will never be sufficiently close to the vertical to achieve an effective scan pattern.

For a better understanding of the invention, reference is made to U.S. Pat. No. 4,050,381 which discloses a submunition having a target sensor, which is incorporated by reference herein.

SUMMARY OF THE INVENTION

The present invention is an orientation stabilization device for any short, blunt or low fineness ratio body. The present invention is particularly useful as an orientation and stabilization device for a submunition. The orientation device provides steady, near vertical descent and near constant spin such that a scan path on the ground is generated in the form of a logarithmic spiral. To accomplish this it is required that the submunition execute a lunar type motion and that the tilt angle of the scan axes from the vertical be nearly constant.

Specifically the invention comprises a short or blunt body stabilized in flight in a lunar motion primarily by the attachment of a single flexible, tip weighted fin or panel, which causes a rotation of the body about an axis tilted with respect to the horizontal.

The area of the fin according to the invention is small enough to allow direct deployment without recourse to staging or realigning.

Rapid spin deceleration is accomplished by the combination of aerodynamic damping and the conversion of some of the rotational momentum of the artillery projectile to translational momentum when the fin is deployed. This conversion also provides dispersion of the plurality of submunitions deployed from a single artillery projectile or like container.

Accordingly, an object of the invention is to utilize a single rigid or non-rigid panel or fin connected to the short body of a submunition to provide deceleration to a steady vertical descent with a near constant spin rate. The panels or fins are cambered, twisted, swept and tip weighted to give a desired rate of spin and a particular tilt to the body such that the desired sensor scan pattern is achieved.

Another object of the invention is to provide a submunition stabilization and orientation device which does not require staging and which tilts the axis of the submunition, using the aerodynamic moment imparted to the body by a fin, and not by the inertial rearrangement of the submunition caused by the presence of a tip weight at the end of the fin. The fin also supplies sufficient aerodynamic drag and spin damping to vertically orient the spin axis during flight.

A further object of the invention is to provide a device which generates a spiral scanning pattern with small distances between successive turns of the spiral (the so-called lacing distance).

A still further object of the invention is to provide a submunition orientation and stabilization device which is simple in design, rugged in construction, small in volume and economical to manufacture.

BRIEF DESCRIPTION OF THE DRAWINGS

In the drawings:

FIGS. 4*a*, 4*b* and 4*c* is a set of orthogonal views of a non-axisymmetric submunition with deployed orientation and stabilization.

FIG. 5 is an explanatory perspective view showing the orientation of the device according to the invention with respect to the ground, and a spiral scan pattern.

DESCRIPTION OF THE PREFERRED EMBODIMENT

Figure 1:
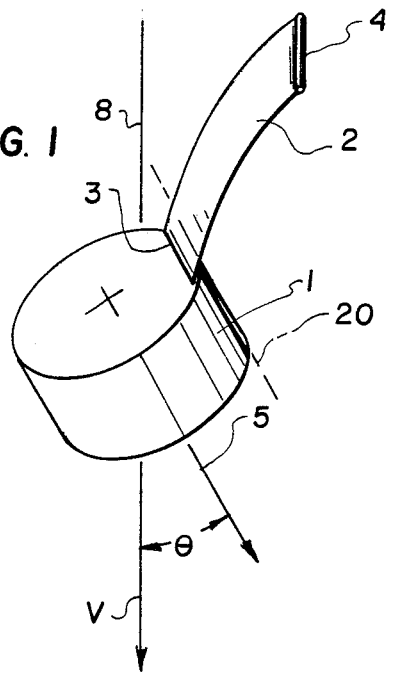
FIG. 1 is an isometric view of a short cylindrical submunition according to the invention with deployed orientation and stabilization fin.

Referring to the drawings in particular, the invention embodied therein in FIGS. 1–4*c* comprises a submunition having a low profile body 1, to which is attached a stabilization and orientation fin 2 with tip weight 4. The fin 2 may be flexible or inflexible and is attached at junction 3 to the body 1. The submunition may be of the SADARM type which includes a target sensor which detects the presence of a suitable target along the axis or a line of sight 5. Such a submunition also includes a self-forging fragment warhead of known design.

Figure 2:
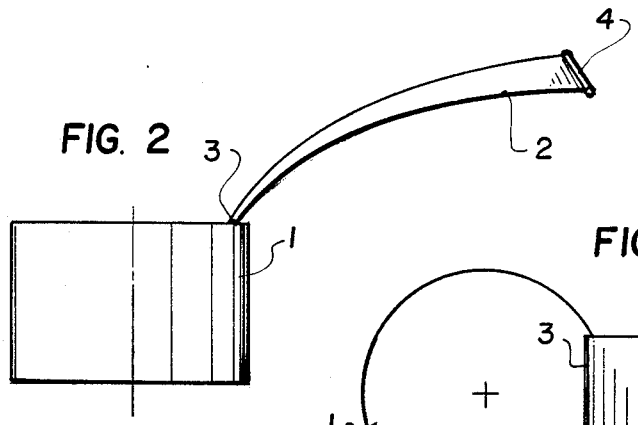
FIG. 2 is a side elevational view of the device of FIG. 1.
Figure 3:
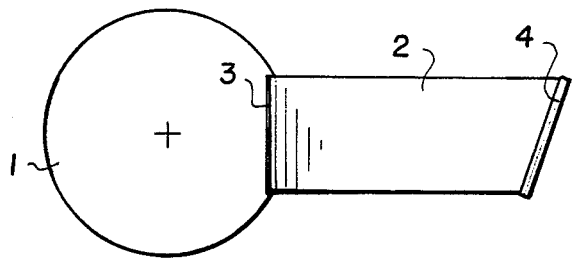
FIG. 3 is a top plan view of the device of FIG. 1.

The attachment at junction 3 between the cylindrical submunition 1 and its fin 2 allows free movement of the fin about the attachment axis 3. In FIGS. 1–3, the deployment of the tip weight 4 stretches the fin 2 and results in the conversion of rotational momentum to translational momentum. The fin 2 of FIGS. 4*a* to 4*c* trails behind the body 1 until the fins 6 cause rotation about the "spin axis". The fin 2 (FIGS. 1–4*c*) is shaped and tip weight selected such that the centrifugal moment and the aerodynamic moment acting on the fin 2 and the cylindrical body 1 balance when the body 1 is at the desired angle of attach $\theta$. Such an angle is for example, 30 degrees. The junction or line 3 is parallel to a tangent 20 of the cylindrical body 1.

The high drag of the fin 2 rotates the trajectory to a vertical descent. This is shown in FIG. 5 for example. The rotation of the body 1 about a vertical axis 8 thus generates a spiral scan pattern 10 which turns in upon itself as the submunition descends at a velocity V.

Thus, as the submunition 12 falls, a defined area is fully scanned for any suitable target. Once a target is located, the submunition reacts in known fashion to destroy the target.

Referring to FIG. 5, the single fin 2 which extends asymmetrically with respect to the cylinder axis 5 causes the submunition 12 to fly a lunar motion at a constant angle of attack $\theta$. The single fin 2 is sufficiently small so that a maximum number of submunitions can be packed into an artillery projectile. As already noted, the electronics safe and arm device, warhead and parachute are all similar to those which comprise the basic prior art SADARM submunition. The one fin device replaces the parachute that is used in such devices while performing improved orientation and spin functions. Five of the present invention submunitions, for example, can be fitted into an artillery projectile, compared to three prior art submunitions.

The submunition shown in FIGS. 4*a*–4*c* may be packaged in a smaller diameter delivery vehicle, a 155 mm artillery projectile for example. The long axis is parallel to the carrier projectile axis of symmetry. A non-axisymmetric (elliptical or oval shaped) self forging fragment warhead is used which spans the flat face 7 and has its center coincident with the scan axis 5. Despin fins 6 are required to rapidly damp the spin rate following ejection from the spinning artillery projectile and to start rotation about the spin axis 8.

The device may include a single fin 2 made of flexible sheet material such as nylon or KEVLAR (a tradename of Dupont Company for a high modulus fiber plastic). The fin connection line may be along either the curved or flat surface of the bodies shown in FIGS. 1 and 4. It also may be tilted (canted) with respect to either face of the body. The leading or trailing edge lines need not be aligned with a diameter of the cylindrical body nor with the long axis of the non-axisymmetric body. These configurational variations, within the bounds of aerodynamic stability, will result in variations in spin rate, descent velocity and sensor axis angle. The tip weight extends the total length of the fin tip. It may be heavier at the leading edge to enhance fin stability. The weight 4 may be chosen for example, to be about 5% of submunition total weight. The proper combination of fabric weave, tip weight configuration and orientation of the connecting line results in the desired camber, twist, sweep and spanwise curvature of the fin that produces lift, drag and stabilization moments appropriate for damping the initial high velocity and spin rate to steady state values. Since the fin on the nonaxisymmetric body is aligned essentially along the initial spin axis, despin vanes are required. These vanes, along with the fin have the effect of turning the angular velocity (spin) vector from alignment with the long axis of the body through an angle of nearly 90° to the scan mode orientation shown in FIG. 5. The body initially rotates about its axis of least inertia. The despin fins damp this rotation and, in combination with the fin cause rotation about the axis of largest inertia.

One preferred embodiment utilizes a 300 mm long, 75 mm wide 475 gm/m$^2$ KEVLAR (a tradename of Dupont Company for a high modulus fiber plastic) fin with a 0.4 kg tip weight. A fin of this configuration would be suitable for stabilizing a 9 kg submunition similar to the device shown in the FIGS. 1–4. The following performance would be expected:

Terminal velocity: 45 m/sec
Scanning spin rate: 50 cycl./sec
Scan angle: 30 degrees In FIG. 5 the final steady state scanning portion of the flight is shown. The scanner with a field of view (FOV) of approximately 5° scans the ground plane 14 in a spiral pattern 10. The distance between spiral scans, the lacing distance, is indicated as $L_D$. The spin is shown at P and descending vertical velocity at V. The offset angle $\theta$ between the light of sight 5 and the vertical descent path 16 is also shown. The submunition is shown at an altitude Z.

As an example of the operation of the invention, the submunitions of FIGS. 1–3 are ejected from an artillery projectile such as the 8 inch M509, at an altitude of 2,000 to 3,500 feet above ground level. As each submunition clears the base of the projectile (not shown), centrifugal force deploys the fin 2. This force, together with the aerodynamic magnus moment disperses the submunitions so that they are each spaced from the other. The aerodynamic lift and drag and the restoring, pitch, damping, roll and roll damping moments slow the spin and translational velocity to steady state values and stabilize the yawing and pitching motions to very small angles. This allows sensors contained within the submunition to search a circular area with a nearly constant lacing distance.

Described is a samara-type decelerator which drives a submunition in a lunar motion while it descends vertically over a battlefield, scanning for armored target. The decelerator, a one-fin device which consists of a double layer of 3 oz./yd$^2$ nylon cloth with a tip weight, evolved from the idea of using a single flexible fin with a tip weight to generate a lunar scan motion, which was compared in some respects with the flight of maple seeds (samaras). Aerodynamic testing consisted of flying various configurations of the submunition in a vertical wind tunnel during which a non-dimensional spin-to-velocity ratio pd/2V of 0.110 and a drag coefficient of 3.21 (based on the submunition's diameter) were obtained. A simulation of the observed lunar motion of an axisymmetric model using a rolling body frame, six-degree-of-freedom (6-DOF) computer program and estimates of the aerodynamic coefficients that could not be measured is discussed.

There has been developed, in one aspect, a samara-type decelerator to orient and stabilize scanning submunitions ejected from a spinning projectile in mid to late flight. As was described previously, the submunitions descend vertically over the battlefield, searching for armored targets. A spiral ground-scan footprint pattern is generated by the rotation of the cylindrical submunition about an axis tilted with respect to its axis of symmetry. When a target is detected, an explosively formed penetrator is (almost) instantaneously fired from the front face of the submunition at the detected target.

The samara decelerator includes in one embodiment a single flexible fin approximately 1.5-body diameters long by 0.6-diameters wide with a tip weight (typically between 2% and 5% of the body weight). It is attached to the top of the cylindrical submunition near the edge. The fin is mounted and shaped to give the camber, twist, and dihedral required for steady spin, descent velocity, and stability. Dispersion may be obtained by sequential deployment of the fin on each submunition, each of which is connected to a submunition to be dropped. The packing volume is about 1/10 th that of a deceleration system using a rotating parachute, it has been observed.

The effectiveness of the design can be demonstrated in free-flight testing of a small scale model, using a single flexible fin, in a vertical wind tunnel (VWT) available at a Government facility. Testing with a full dimensional scale model in the VWT can demonstrate a precision planned fall including a constant spin rate, descent velocity, and a scan angle near the design value of 30 degrees. Presented are some results of VWT testing of the samara-body combination. A set of aerodynamic coefficients was estimated and then refined using a six-degree-of-freedom (6-DOF) computer program to simulate the motion observed in the VWT. The wind tunnel model consisted of an approximately full dimensional scale, right circular cylinder made of LEXAN (a tradename of General Electric Company for a polycarbonate plastic) (35% of the weight of an actual submunition) and a single flexible fin as an orientation and stabilization device. The cylinder was 4.75-in. in diameter and 3.40-in. long. The flexible fin was made of a double layer of 3 oz/yd$^2$ nylon and had a 7.5-in. span and a 3 in. chord. It was attached at the edge of the cylindrical submunition body and weighted at the tip. The tip weight was a steel cylinder with its center of gravity (CG) slightly forward of the mid-chord of the fin. (Subsequent testing showed the fin to be more stable, particularly during the spin up phase, if the CG of the tip weight were located at the quarter-chord position). The model weighed 2.78 lb. and the tip, 0.085 lb. The physical characteristics of the wind tunnel model were evaluated with a computer program capable of calculating moments and products of inertia, center of gravity, mass, and the orientation of the principal axes of inertia for asymmetric bodies. For purposes of modeling, the submunition was treated as a rigid body with three parts: the cylindrical body, the flexible fin, and the tip weight. It was assumed that in flight the orientation of the fin was normal to the spin axis, and the axis of symmetry of the body was tilted at the scan angle ($\alpha$ scan) to the spin axis. A program was run for different values of $\alpha$ scan until the spin axis was aligned with a principal axis of inertia which is the angle about which the body would rotate in the absence of any external moments. The angle for this configuration was 31 degrees. A set of curves can be computed to show the effect of tip weight mass and fin length on the scan angle whether for a LEXAN (a tradename of General Electric Company for a polycarbonate plastic) body; or for an aluminum body. Increasing the tip weight and/or the fin length will increase the scan angle, although plots indicate a maximum angle of about 50 degrees for this size body. The submunition flew at a "steady state" with a velocity of 77 ft/s and angular velocity of 47.1 rad/s as determined from motion pictures. The term "steady-state" is used in a sense appropriate to wind tunnel test conditions. "Steady state" is constant angular velocity about the spin axis and a constant vertical (Z-Earth) velocity. The drag coefficient ($C_D$) of 3.21 is based on body diameter. Model spin-up as a function of time can be obtained from VWT motion pictures. The moment coefficients $C_l$ and the roll damping moment coefficients $C_{lp}$ can be obtained from a computer program which numerically solves the equation:

$$\dot{p} = \frac{\frac{1}{2}\rho V^2 Sd}{I_{xx}}\left[C_l + (C_{lp0} + C_{lp2})\frac{pd}{2V}\right] \quad (1)$$

The resulting $C_l$ was 0.282 and the $C_{lp}$ varied between $-1.59$ and $-2.45$. After an initial transient period, the cylindrical body flies in a lunar motion at a constant angle-of-attack or scan angle of 25 degrees. The fin was oriented 10 degrees above the horizontal and was curved along the span. The radius of curvature measured from motion pictures was 12 inches. The physical characteristics of the submunition with the fin, in steady-state orientation (35 degrees above the top of the body) were evaluated and the principal axes were found to be rotated by 32 degrees with respect to the body axis of symmetry. The moments of inertia were $I_{xx}$=13.65 lb-in.$^2$
$I_{yy}$=9.36 lb-in.$^2$
$I_{zz}$=15.49 lb-in.$^2$
$I_{xy}$=4.39 lb-in.$^2$ The body was observed to be spinning about an axis 25 degrees off the cylinder symmetry axis rather than at 32 degrees (the direction of the principal axis of largest inertia) due to the external aerodynamic moment acting on the fin. From Euler's equations of motion, this moment is 6.78 in.-lb. A full-weight aluminum submunition is also successfully flown in the VWT.

The flight of the submunition can be modeled by use of a 6-DOF computer simulation. A program is capable of using a body-fixed or fixed plane coordinate system and can handle aerodynamic and geometric asymmetries. To simulate the motion observed in the VWT, a body-fixed coordinate system can be used. The orientation of the body axes with respect to the fixed inertial (Earth) coordinates is described by three Euler angles ($\psi$, $\theta$, and $\phi$) with $\psi$ the first rotation, $\theta$ the second, and $\phi$ the third. The body axes (shown aligned with the inertial Earth axes); the positive sense of pitch, yaw, and spin rates, and the Euler angles are noted. The basic aerodynamic coefficients used in the program are defined in an aeroballistic system for symmetric missiles. The presence of the flexible fin on the body, however, makes it highly nonsymmetric. The program can also include terms for aerodynamic asymmetries: the moment coefficients $C_{mo}$ and $C_{no}$, and the force co-efficients $C_{Yo}$ and $C_{Zo}$. The positive sense of the aerodynamic forces and moments are noted. As observed in VWT tests, the body flies at a constant scan angle (angle of attack) of 25 degrees and a constant angular velocity of 47.1 rad/s. A program can be run using initial conditions from a wind tunnel test: initial velocity of 77 ft/s, initial spin rate of 25.1 rad/s and an angle of attack of 0 degrees. This process can be repeated until the transient motion damps out in 2 or 3 seconds and the computed motion will agree with the observed motion. Other combinations of coefficients ($C_{mp}$, $C_{mo}$, $C_{nr}$, $C_{mq}$) can produce an acceptable match of the wind tunnel results. Scan angle was found to increase with the length of the fin and/or the mass of the tip weight. A set of aerodynamic coefficients can be determined for the submunition which is adequate to simulate the motion observed in a wind tunnel on a six-degree-of-freedom computer program.

While a specific embodiment of the invention has been shown and described in detail to illustrate the application of the principles of the invention, it will be understood that the invention may be embodied otherwise without departing from such principles.

What is claimed is:

1. A rotating submunition including a target sensor means to search a circular area on the ground in a swath, with a nearly constant lacing distace, in lunar motion at a scan rate equal to the rotational rate of the submunition, said submunition comprising an aluminum cylindrical shaped body having a defined line of sight axis with sensor means at the bottom thereof facing the ground, said body further including a flexible wing element having relative aerodynamic lift, attached near the top on the side of the said submunition, connected at a curved surface to said submunition, said wing comprised of a double layer of nylon cloth of 3 oz./yd$^2$ density, of length dimension 1.5 body diameters and width of 0.6 diameters, of said submunition, including a tip weight along the entire width of the wing's chord, placed on top of said wing near the edge, with the weight's center of gravity at the one-quarter chord position for stability in the start up phase, the weight being 2 to 5% of the submunition body weight, for orientating and stabilizing the flight of said submunition, said wing having sufficient aerodynamic lift moment whereby with said body dropped in flight in a relatively straight descent direction without initial spinning of said body substantially, said wing is acted on aerodynamically and in turn tilts said body sight axis with respect to said descent direction and further rotates said body in lunar motion about said descent direction at a steady state velocity, said wing either rotating the body when beginning from essentially zero rotation in a dead drop up to the steady state velocity, or slowing rotation down to the steady state amount during descent if originally larger, no further energy needed to maintain the steady state spinning other than the aerodynamic action alone during descent acting on the wing, there being no degradation of the spin rate over time, said lunar motion enabling said target sensor to scan approximately once per each revolution in the pattern of a swath along the ground, following a path which has the geometry of a logarithmic spiral.

2. The submunition as in claim 1 wherein a plurality of said submunitions may be tightly packed for transportation by virtue of the flexibility of the wing element.

3. A submunition according to claim 1, wherein said body has a height along said axis less than a dimension thereof transverse to said axis.

4. A submunition according to claim 1, wherein said tip weight extends across the entire outer end of said wing element and at an angle to a tangent of said body.

5. A submunition according to claim 1, wherein the surface of connection between said wing element and said body is parallel to a tangent to the cylindrical curved surface of said body.

6. A submunition according to claim 1, wherein the surface of connection between said fin and said body is at an angle to the body's line of sight axis, adapted to permit said wing element to rotate said body.

7. A submunition according to claim 1, wherein the wing element is made of a nylon sheet material.

* * * * *